US007861569B2

(12) United States Patent
Cotter et al.

(10) Patent No.: US 7,861,569 B2
(45) Date of Patent: Jan. 4, 2011

(54) REACTION DEVICE FOR FORMING EQUIPMENT

(75) Inventors: Jonathan P. Cotter, Dearborn, MI (US); Michael C. Diebolt, Northville, MI (US)

(73) Assignee: Dadco, Inc., Plymouth, MI (US)

( * ) Notice: Subject to any disclaimer, the term of this patent is extended or adjusted under 35 U.S.C. 154(b) by 1504 days.

(21) Appl. No.: 11/232,674

(22) Filed: Sep. 22, 2005

(65) Prior Publication Data

US 2007/0204448 A1 Sep. 6, 2007

(51) Int. Cl.

| | |
|---|---|
| ***B21D 22/21*** | (2006.01) |
| ***B21D 26/00*** | (2006.01) |
| ***B21J 11/00*** | (2006.01) |
| ***B30B 1/23*** | (2006.01) |

(52) U.S. Cl. ..... 72/351; 72/405.06; 72/466.9; 100/269.01

(58) Field of Classification Search ..... 72/351, 72/361, 405.06, 405.07, 420, 453.13, 466.9, 72/482.91; 267/113, 114, 118, 119–121, 267/124, 126; 100/258 R, 259, 265, 266, 100/269.01

See application file for complete search history.

(56) References Cited

U.S. PATENT DOCUMENTS

| | | | | |
|---|---|---|---|---|
| 5,113,746 | A | 5/1992 | Yuda | |
| 5,245,904 | A | 9/1993 | Meyerle | |
| 5,275,387 | A | 1/1994 | Cotter et al. | |
| 5,303,906 | A | 4/1994 | Cotter et al. | |
| 5,918,708 | A | 7/1999 | Yuda, Jr. | |
| 6,848,290 | B2 | 2/2005 | Pyper et al. | |
| 2004/0069041 | A1 * | 4/2004 | Pyper et al. | 72/405.06 |

FOREIGN PATENT DOCUMENTS

| | | | |
|---|---|---|---|
| GB | 1 285 774 | A | 8/1972 |
| KR | 2003 0037643 | A | 5/2003 |
| WO | WO 2004/048802 | A | 6/2004 |

* cited by examiner

*Primary Examiner*—Teresa M Bonk
(74) *Attorney, Agent, or Firm*—Reising Ethington P.C.

(57) ABSTRACT

A reaction device for forming equipment includes a base, a reaction member movably spaced therefrom by guides, and a return gas spring carried by the base and operatively engaged to the reaction member for yieldably biasing the reaction member away from the base. The base has a return gas spring passage and guide shaft passages spaced apart therefrom. A return gas spring is received in the return gas spring passage of the base, and has a piston rod with an end arranged for contact with the reaction member. The guides include guide shafts arranged for engagement with the reaction member and disposed in guide bushings, which are received in the guide shaft passages of the base and preferably project below the base for use in locating the reaction device on the forming equipment.

21 Claims, 3 Drawing Sheets

REACTION DEVICE FOR FORMING EQUIPMENT

FIELD OF THE INVENTION

This invention relates generally to forming equipment, and more particularly to a reaction device for use with forming equipment.

BACKGROUND OF THE INVENTION

Gas springs are commonly used in various implementations in forming equipment to provide a movable component of a forming die with a yielding force, which is maintained throughout normal travel of the movable component. For example, in a binder ring implementation, a gas spring provides a yielding force against a binder ring of a forming die to hold a metal workpiece while another part of the forming die forms, cuts, stretches, or bends the workpiece. In a lifter implementation, the gas spring provides a yielding force to lift a workpiece off a surface of the forming die. In a cam tool implementation, the gas spring applies a yielding force to return a cam-activated tool to its home position.

Conventional gas springs, such as those disclosed in U.S. Pat. Nos. 5,275,387 and 5,303,906, typically have a piston rod disposed within a generally hollow cylinder including a closed rear end with a fill valve disposed therein, and a sealing assembly closing a forward open end of the cylinder and including a reinforcing or retaining ring and seals between the rod and the cylinder. Thus, a sealed gas chamber is defined between a rear end of the piston rod and the inside of the cylinder. The gas chamber receives a pressurized gas for yieldably biasing the piston rod to an extended position and for yieldably resisting movement of the piston rod from its extended position to a displaced or retracted position within the cylinder.

For example, upon closure of forming dies toward one another, a force is exerted on the piston rod, which force immediately yields a resultant reactive force of the gas spring. As the piston rod is displaced into the cylinder, the gas becomes further compressed. This gas compression by the piston causes the gas volume to decrease and, in accordance with Boyle's law, increases the gas pressure and thereby increases the resultant reactive force imposed on the die. And, the greater the piston displacement, the greater the reactive force. The sealing arrangements between the end cap and the cylinder, and between the piston rod and the cylinder prevents the release of the pressurized gas, thereby assuring the rise in gas pressure within the chamber.

The gas springs are capable of handling compression loads that are substantially parallel to the piston rod, but are not capable of resisting significant torque or side loading. Therefore, guide posts are often attached to the forming die and on either side of the gas spring to handle torque and side loading. Unfortunately, however, integration of guide posts directly into a forming die alongside a gas spring usually requires precious additional space on the forming die, costly customized design of the forming die and guide post assembly, and a fixed stroke length of the gas spring.

SUMMARY OF THE INVENTION

A reaction device is relatively compact, of modular design, and preferably available in different lengths or is otherwise adjustable in stroke length for use in a variety of different applications with forming equipment. The reaction device includes a base, a reaction member movably spaced from the base by guides, and a return gas spring carried by the base and operatively engaged to the reaction member for yieldably biasing the reaction member relatively away from the base. The base has a return gas spring passage and guide shaft passages spaced apart from the return gas spring passage. The return gas spring is received in the return gas spring passage of the base and has a piston rod with an end arranged for contact with the reaction member. The guides include guide bushings carried by the base and received in the guide shaft passages thereof, and at least one of the guide bushings preferably has an end projecting below the base for use in locating the reaction device on the forming equipment, such as in doweling the reaction device to a forming machine. The guides also include guide shafts received in the guide bushings, and at least one of the guide shafts includes an end arranged for engagement with the reaction member to movably support the reaction member with respect to the base.

According to a preferred aspect of the reaction device, the reaction member includes guide shaft apertures having flat portions for engagement with corresponding flat portions of the ends of the guide shafts. According to another preferred aspect, the guide bushings are carried by the base in an axially adjustable manner with retaining members therebetween. The guide bushings include a plurality of external circumferential grooves, the base includes a corresponding internal circumferential groove within at least one of the guide shaft passages, and the retaining members are disposed between the base and the guide bushings.

At least some of the objects, features and advantages that may be achieved by at least some embodiments of the invention include providing a reaction device that is readily adaptable to various forming equipment applications including binder ring, lifter, and cam tool applications; maximizes guidance precision and load capacity while minimizing external dimensions; provides a standardized design that can be "dropped in" to existing forming machine or tool designs; is compact and easy to rebuild; and is of relatively simple design and economical manufacture and assembly, rugged, durable, reliable and in service has a long useful life.

Of course, other objects, features and advantages will be apparent in view of this disclosure to those skilled in the art. Various other reaction devices embodying the invention may achieve more or less than the noted objects, features or advantages.

BRIEF DESCRIPTION OF THE DRAWINGS

These and other objects, features and advantages of the present invention will be apparent from the following detailed description of the preferred embodiments and best mode, appended claims, and accompanying drawings in which:

DETAILED DESCRIPTION OF THE PREFERRED EMBODIMENTS

Figure 1:
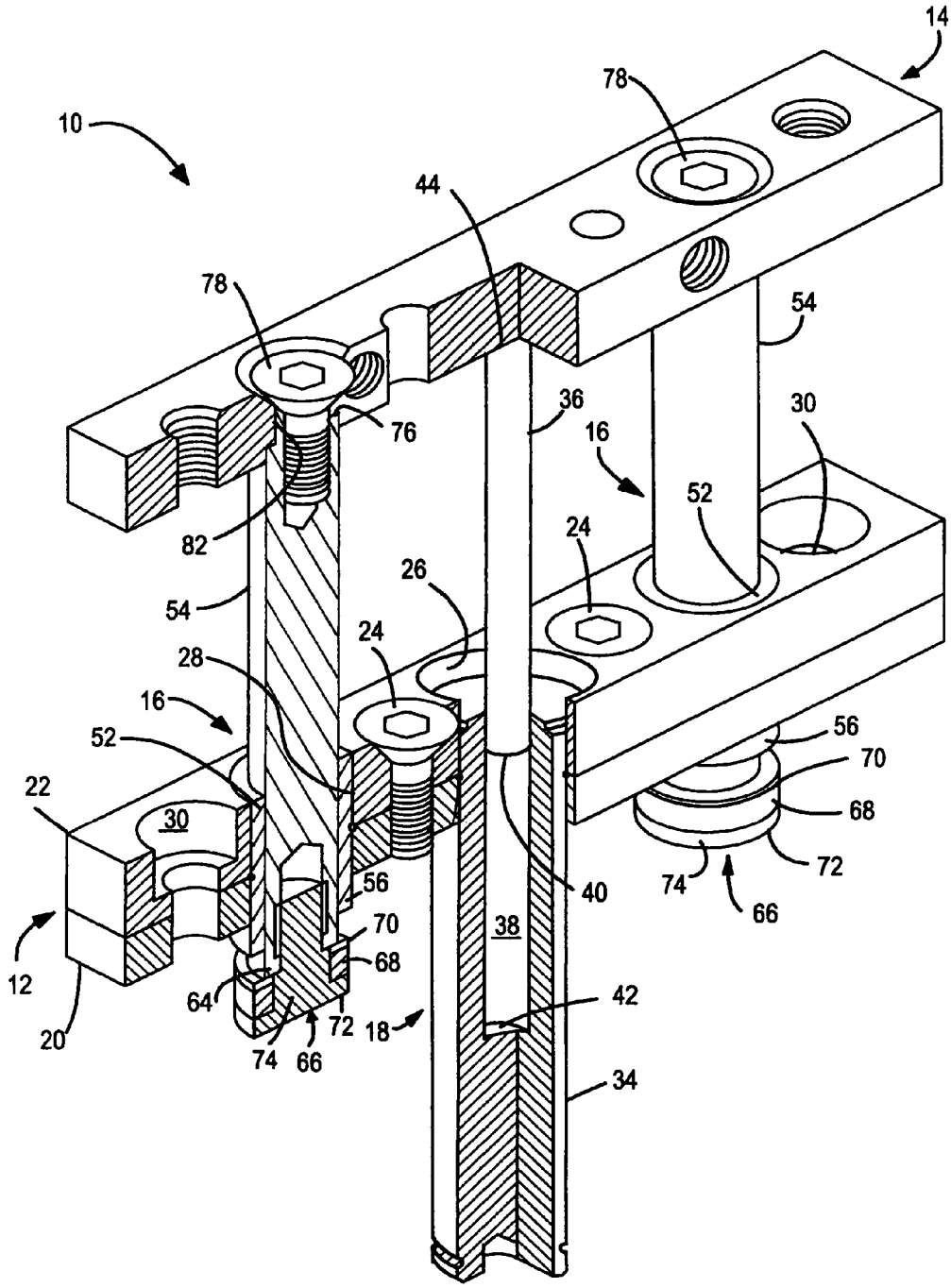
FIG. 1 is a perspective cross-sectional view according to a presently preferred form of a reaction device for use with forming equipment.
Figure 3:
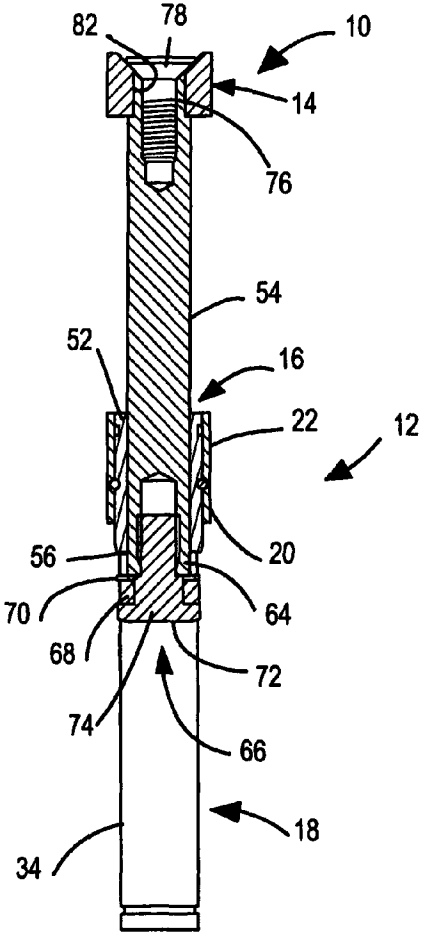
FIG. 3 is a side cross-sectional view of the reaction device of FIG. 1, taken along line 3-3 of FIG. 2.
Figure 2:
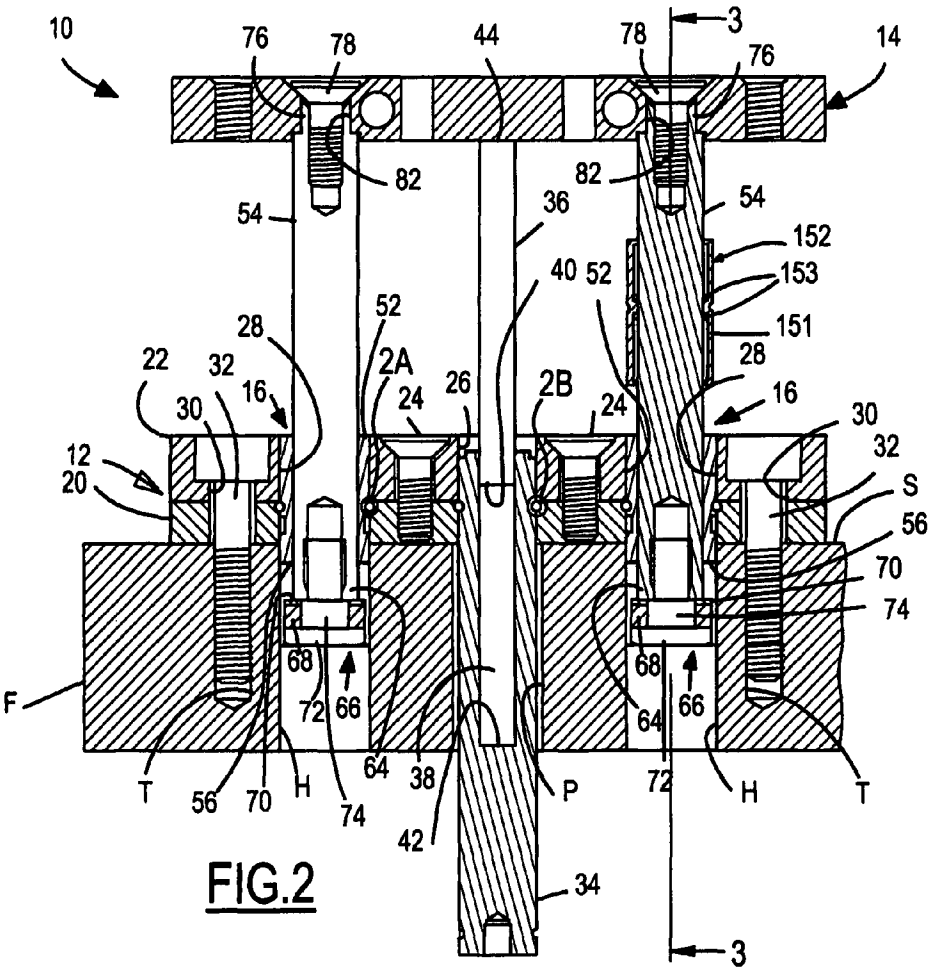
FIG. 2 is a front cross-sectional view of the reaction device of FIG. 1.

Referring in more detail to the drawings, FIGS. 1 through 3 illustrate a reaction device 10 arranged for use with metal forming equipment F such as a forming machine, tool, or die. The reaction device 10 may be used with the forming equipment F as a binder ring, workpiece lifter, cam tool return, or the like. In general, the reaction device 10 includes a base 12 for mounting the device 10 to the forming equipment F, a reaction member 14 that is movably carried by the base 12 by guide devices 16 and that is yieldably disposed in an extended position by a return gas spring 18. More guide devices 16 and/or return gas springs 18 could be used, depending on the desired overall size and shape of the reaction device 10.

The base 12 mounts the device 10 to the forming equipment F and supports the other various components of the device 12, such as the guide devices 16 and return gas spring 18. The base 12 may be a single plate component or a multiple plate assembly as shown. Preferably, the base 12 is of sandwich-like construction including a lower plate 20 for mounting against the forming equipment F and an upper plate 22 mounted against the lower plate 20. The plates 20, 22 may be fastened together with machine screws 24 or other types of fasteners, and the entire base 12 can be bolted in place to the forming equipment F. The base 12 is preferably rectangular in shape and includes a centrally disposed return gas spring passage 26 therethrough for accepting the return gas spring 18 therein. The base 12 further includes guide passages 28 therethrough on either side of the return gas spring passage 26 for accepting the guide devices 16 therein. The base 12 also includes bores 30 for accepting recessed fasteners 32 such as cap screws, bolts, or other types of fasteners suitable for use in fastening the reaction device 10 to the forming equipment F.

The forming equipment F includes relatively straightforward machining preparation to install the reaction device 10. Because of the low profile and flat lower plate 20 of the base 12, the forming equipment F is preferably prepared with a machined flat surface S for engagement with the base 12. Also, the forming equipment F is preferably prepared with three precision drilled or bored holes H, P for accepting the guide devices 16 and return gas spring 18, and with two outboard tapped holes T for fixing the reaction device 10 in place.

The return gas spring 18 may be any suitable device for yieldably biasing the reaction member 14 in a direction away from the base 12, but is preferably a nitrogen gas spring adapted for mounting to the base 12 within the return gas spring passage 26 thereof. The return gas spring 18 also extends into a return gas spring passage P within the forming equipment F as shown in FIG. 2. Nitrogen gas springs are readily available from the assignee hereof, such as the DADCO Micro Series, including the Micro C.090 line of products.

The return gas spring 18 shown in the drawing figures is a simplified schematic and, internally, may be constructed in accordance with U.S. Pat. Nos. 5,275,387 and 5,303,906, which patents are incorporated by reference herein in their entireties. The gas spring 18 may include a housing or generally hollow cylinder 34 and a piston rod 36 disposed within the cylinder 34, wherein a sealed gas chamber 38 is defined between a cylinder end 40 of the piston rod 36 and a bottom 42 of the chamber 38 inside the cylinder 34. A closed rear end of the gas spring 18 is preferably fitted with a fill valve (not shown) therethrough for receiving pressurized gas from a remote source. At an opposite end of the gas spring 18, a reaction end 44 of the rod 36 is arranged for abutment or contact with the reaction member 14. Those of ordinary skill in the art will recognize that the housing or cylinder 34 need not be cylindrical in shape but could be of any other suitable shapes.

The gas chamber 38 preferably retains a pressurized gas for biasing the piston rod 36 to an extended position and for resisting movement of the piston rod 36 from its extended position to a displaced or retracted position in the cylinder 34. The gas spring 18 may be in fluid communication with a control panel (not shown) through a high pressure hose and fittings. The mini control panel is preferably a DADCO model # 90.407.11 mini control panel, which is used to fill, drain, and monitor the pressure of a plurality of gas springs that are linked either in series or in parallel from outside of a die. The mini control panel includes a high pressure gauge, a quick disconnect fill valve, a bleed valve, and a rupture disk to prevent over-pressurization of the gas springs. This arrangement enables common pressurization or activation of a group of multiple or tandem reaction devices that are all attached to a common structural member on the forming equipment. Accordingly, the group of reaction devices may be actuated simultaneously from the control panel. Also, if a gas spring of one of the reaction devices supporting the common structure is overpowered or fails, then the other gas springs of the other reaction devices share the load previously carried by the failed reaction device to prevent or reduce the liklihood of damage to the forming equipment.

The return gas spring 18 is preferably carried by the base 12 using a split-type mounting configuration. Accordingly, the cylinder 34 of the return gas spring 18 includes at least one external circumferential groove 46, and may have two or more axially spaced apart circumferential grooves 46, and the base 12 includes a corresponding internal circumferential groove 48, wherein a retaining member 50 is mutually disposed in groove 48 and one of the grooves 46 for retaining the return gas spring 18 in the base 12. As used herein, the term groove includes any generally circumferential or annular channel or depression and encompasses open counterbores, closed channels, and the like.

Any suitable types of retaining members may be used and, for example, may be circumferentially continuous or interrupted, and of round or rectangular cross-section. More specifically, the retaining members may be outer diameter wire snap rings, round wire split rings, flat spiral type snap rings, or the like. In any case, the internal circumferential groove 48 in the base 12 is preferably formed as a face groove in the lower plate 20 of the base 12, and coaxially disposed with respect to the return gas spring passage 26. Also, before the upper plate 22 is mounted to the lower plate 20, it is preferred that the retaining member 50 is first assembled within the groove 46 of the return gas spring cylinder 34, which is then assembled into the return gas spring passage 26 of the lower plate 20 portion of the base 12 until the retaining member 50 seats in the groove 48 in the lower plate 20 of the base 12.

The guide devices 16 preferably include guide bushings 52 retained within the guide shaft passages 28 of the base 12 and carried by the base 12, and guide shafts 54 received in the guide bushings 52. But the guide devices 16 may be any suitable individual component or combination of components for movably attaching the reaction member 14 to the base 12 and locating the base 12 to a forming machine. For example, the guide bushings 52 could be omitted wherein the guide shafts 54 would be received directly within the respective guide shaft passages 28 of the base 12. In such a case, it would be desirable to plate the steel base 12 with a coating, such as nickel-Teflon, on the guide shaft passages 28, or the base 12 could be composed of iron or a copper alloy.

The guide bushings 52 are preferably substantially cylindrical, solid, one-piece components, for example composed of bronze. Or, as alternatively shown at numeral 152 in FIG. 2, the bushings 52 may be multiple-piece components including a metal sleeve 151 or housing with one or more thin-walled bushing rings 153 press fit therein and preferably composed of steel and brass. The bushings 152 are not shown in correct position, and are shown for exemplary purposes only. Also, the bushings 52, 152 may be pre-lubricated, such as with graphite plugs or grooves or impregnated with lubricant.

In any case, the bushings 52 preferably have lower ends 56 that project below the lower plate 20 of the base 12 and into the guide passages H in the forming equipment F for use as doweling devices in locating the reaction device 10 to the forming equipment F. The bushings 52 may extend any suitable distance below the base 12 so as to suitably engage the forming equipment F, but preferably extend about three to seven millimeters or more. Accordingly, the guide passages 28 in the base 12, the outer diameter of the bushings 52, and the guide passages H in the forming equipment F are preferably precision machined. This dual use of the bushings 52 as guiding devices and as dowels eliminates the need for other doweling of the base 12 to the forming equipment F. Adding extra dowel pins and holes to the base 12 would make the reaction device 10 unnecessarily wider or longer. Thus, the construction and assembly of the reaction device 10 is kept simple and its packaging envelope is maintained as small as possible.

Referring to FIGS. 2, 2A, 2B, and 6, the guide bushings 52 are preferably retained in the base 12 in a similar fashion as the return gas spring 18, using a split-type mounting configuration. The outer diameter of each bushing 52 may be precision ground and include one or more external circumferential grooves 58. Also, the base 12 includes a corresponding internal circumferential groove 60 concentric with the passage 28, wherein a retaining member 62 is mutually disposed in the grooves 60 and one of the grooves 58 for retaining the bushings 52 in the base 12. Preferably, the internal circumferential groove 60 is formed as a face groove in the lower plate 20 of the base 12, and coaxially with respect to the bushing passage 28. Also, before the upper plate 22 is mounted to the lower plate 20, it is preferred that the retaining member 62 is first assembled within one of the grooves 58 of the bushing 52, which is then assembled into the bushing passage 28 of the lower plate 20 until the retaining member 62 seats in the groove 60 in the lower plate 20.

Figure 7:
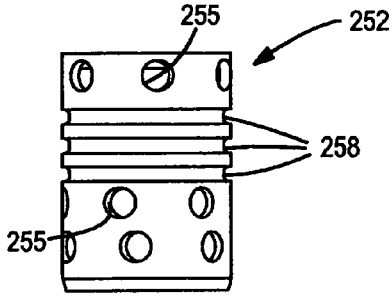
FIG. 7 is a side view of another preferred form of a guide bushing suitable for use with the reaction device of FIG. 1.
Figure 2A:
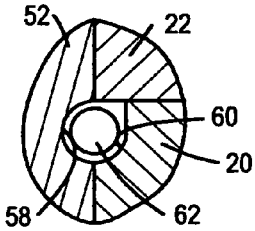
FIG. 2A is an enlarged view of encircled portion 2A of the reaction device of FIG. 2.
Figure 2B:
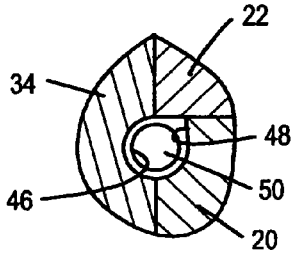
FIG. 2B is an enlarged view of encircled portion 2B of the reaction device of FIG. 2.

In another bushing configuration, as shown in FIG. 7, a guide bushing 252 may be used that includes holes 255 extending radially or transversely therethrough, and external circumferential grooves 258 therein. The grooves 258 are provided so that the bushings 252 may be carried by the base in an axially adjustable manner to enable axial or stroke adjustments in the reaction device 10. In other words, the bushings 252 may be fastened to the base 12 using, for example, lower grooves thereof for maximum stroke or distance between the reaction member 14 and base 12. Or the bushings 252 may be fastened to the base 12 using upper grooves for minimum stroke of the reaction member 14 and greater preload on the return gas spring 18.

The guide shafts 54 of the guide devices 16 are substantially cylindrical and include base ends 64 that are inserted within the guide bushings 52. Guide stops 66 retain the movable guide shafts 64 in the base 12, are attached to the base ends 64 of the guide shafts 54, and include a resilient cushion 68 sandwiched between a cushion spacer or washer 70 and a head 72 of a guide stop shoulder screw 74 threadably received in the guide shaft. The cushion 68 may be composed of a composite material or a polymer such as urethane, and the cushion washer 70 may be composed of any suitable material including brass or steel. The cushioned guide stops 66 enable deceleration and dampening of the momentum of the moving guide rods 54, reaction member 14, and anything that may be mounted to the reaction member 14 when the reaction member 14 reaches the end of the stroke defined by the guide rods 54 and, thus, comes to a stop.

This cushioning action enables a reduction in stresses on the reaction member 14 and yields more controlled extension of the reaction member 14. The reaction device load capacity may be determined based on maximum cyclical stresses and the speed at which the mass on the reaction member 14 should decelerate. The shoulder screw 74 may be used to pre-load the cushion 68 if desired, and enables use of pre-ground shaft material for the guide posts 54, instead of forged or cast shafts or the like. Unlike some conventional designs, the cushion 68 cannot ride up the guide shafts 54 when the reaction device 10 is compressed.

The reaction device 10 may also be rendered adjustable in stroke length by using additional precision spacers or washers 70 between the cushion 68 and the ends 64 of the guide shafts 54. The additional washers would be matched pairs to provide precision stroke length adjustment for both guides. As shown, a single washer 70 acts as a "zero" or baseline spacer and adding washers, and/or replacing the washer 70 with washers of different thickness, would enable the stroke of the reaction device 10 to be adjusted to desired travel specifications without having to provide a special adjustable stroke length gas spring.

Figure 5:
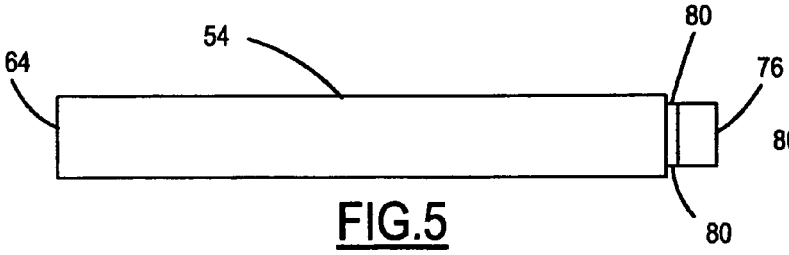
FIG. 5 is a side view of a guide shaft of the reaction device of FIG. 1.
Figure 5A:
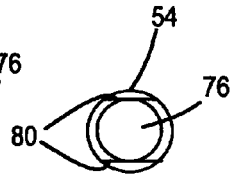
FIG. 5A is an end view of the guide shaft of FIG. 5.
Figure 6:
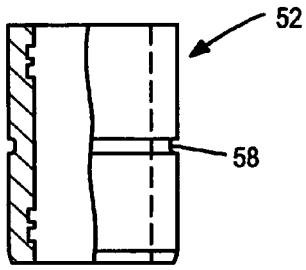
FIG. 6 is a partially sectioned side view of a presently preferred form of a guide bushing of the reaction device of FIG. 1.

Opposite of the base ends 64, the guide shafts 54 include reaction ends 76 that are fastened to the reaction member 14 by recessed fasteners 78 such as machine screws, bolts, or other types of fasteners. As better shown in FIGS. 5 and 5*a*, the guide shaft reaction ends 76 include a reduced diameter portion having opposed flats 80 for keyed engagement with the reaction member 14 as will be described herein below.

Referring to FIGS. 1 and 2, the reaction member 14 may be a steel plate, sub-plate, or the like, for supporting other components or devices. The reaction member 14 is spaced apart from the base 12 by the movable guide shafts 54 and, thus, is movable toward and away from the base 12. The reaction member 14 includes spaced apart guide shaft apertures 82 for receiving the reaction ends 76 of the guide shafts 54, and an intermediate section 84 between the plurality of guide shaft apertures 82 for cooperation with the reaction end 44 of the return gas spring piston rod 36.

Figure 4:
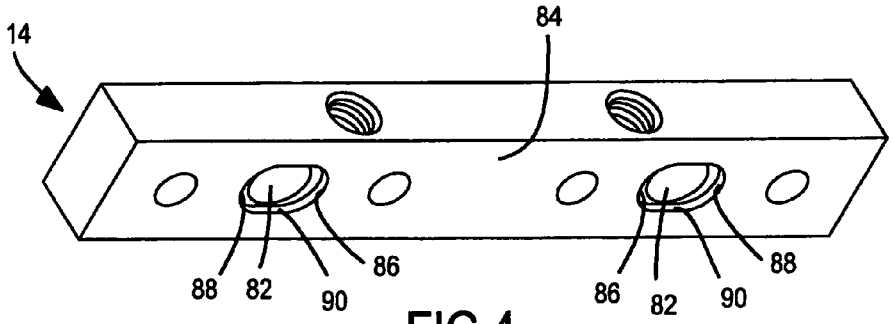
FIG. 4 is a perspective view of a reaction member of the reaction device of FIG. 1.

As better shown in FIG. 4, the guide shaft apertures 82 are preferably counterbored to include oblong recesses or counterbores 86. The oblong counterbores 86 preferably each include opposed rounded ends 88 that engage the corresponding diameter of the reaction ends 76 of the guide shafts 54 and opposed flat sides 90 that correspond to the flats 80 of the reaction ends 76 of the guide shafts 54. Accordingly, the flats 76 on the guide shafts 54 and the flats 90 of the reaction member 14 engage to prevent rotation of the guide shafts 54 relative to the reaction member 14. With this construction, the guide shafts 54 do not need to be provided with wrench flats. Wrench flats are conventionally required for service or assembly and tend to reduce the effective bearing area of associated guide shafts. With this reaction device 10, however, the keyed engagement between the guide shafts 54 and the reaction member 14 eliminates the need for wrench flats and provides maximized guide shaft bearing area for a given distance between the reaction member 14 and base 12.

The reaction member 14 may include various other features, such as threaded holes, dowel holes, and the like, to enable various desired uses of the reaction member 14. For example, the reaction member, or some tool mounted thereto, may be used as a binder to clamp down on a workpiece during forming thereof, a lifter plate for lifting a workpiece after forming thereof, a cam return member for returning a cam tool after a forming operation on a workpiece, or the like.

In operation, the reaction device 14 is normally in its fully extended state, wherein the piston rod 36 of the return gas spring 18 is fully advanced. In the fully extended state, the guide shafts 54 are fully displaced until the guide stops 66 are located against the lower ends 56 of the guide bushings 52 such that the distance between the reaction member 14 and base 12 is maximized. In contrast, the reaction device 10 may be displaced to its fully compressed state, wherein the reaction device 10 reacts to some movement of some mechanism of the forming equipment F to which the reaction device 10 is mounted. For example, an upper ram or platen (not shown) of a forming press may advance toward, then contact, and ultimately displace the reaction member 14 in a direction toward the base 12. Thereafter, when the upper platen of the forming press retracts away from and ultimately disengages the reaction device 10, the reaction device 10 returns to its state of rest under its own power of its return gas spring 18, wherein the piston rod 36 advances and displaces the reaction member 14 away from the base 12 until the guide stops 66 engage the bushings 52. As shown, the reaction device 10 is slightly displaced from its fully extended position toward its retracted position, such that the guide stops 66 are spaced away from the lower ends 56 of the bushings 52.

As best illustrated by FIGS. 2 and 3, the overall envelope of the reaction device 10 is minimized relative to the guiding precision and load capacity of the reaction device 10. In other words, the operational stiffness and smoothness of the reaction device 10 is high in proportion to the width and thickness of the base 12 and reaction member 14. As just one example, 16 mm diameter guide shafts may be used for a 25 mm wide reaction member. Similarly, a 19 mm diameter return gas spring may be used with a 26 mm thick base. These dimensions are merely illustrative of the compact packaging achievable with the design of the present reaction device 10, and are not to be construed as limitations of the claimed reaction device.

As used in this specification and claims, the terms "for example," "for instance," and "such as," and the verbs "comprising," "having," "including," and their other verb forms, when used in conjunction with a listing of one or more components or other items, are each to be construed as open-ended, meaning that that the listing is not to be considered as excluding other or additional components, elements, or items. Moreover, directional words such as top, bottom, upper, lower, radial, circumferential, axial, lateral, longitudinal, vertical, horizontal, and the like are employed by way of description and not limitation. Other terms are to be construed using their broadest reasonable meaning unless they are used in a context that requires a different interpretation. When introducing elements of the present invention or the embodiments thereof, the articles "a," "an," "the," and "said" are intended to mean that there are one or more of the elements.

It is to be understood that the invention is not limited to the particular exemplary embodiments disclosed herein, but rather is defined by the claims below. In other words, the statements contained in the foregoing description relate to particular exemplary embodiments and are not to be construed as limitations on the scope of the invention as claimed below or on the definition of terms used in the claims, except where a term or phrase is expressly defined above.

Although the present invention has been disclosed in conjunction with a limited number of presently preferred exemplary embodiments, many others are possible and it is not intended herein to mention all of the possible equivalent forms and ramifications of the present invention. Other modifications, variations, forms, ramifications, substitutions, and/or equivalents will become apparent or readily suggest themselves to persons of ordinary skill in the art in view of the foregoing description. In other words, the teachings of the present invention encompass many reasonable substitutions or equivalents of limitations recited in the following claims. As just one example, the disclosed structure, materials, sizes, shapes, and the like could be readily modified or substituted with other similar structure, materials, sizes, shapes, and the like. In another example, the invention has been disclosed in conjunction with metal forming equipment. However, additional applications are contemplated for the reaction device, such as in injection molding equipment, plastic sheet molding equipment, or any other suitable machine applications where it is desirable to use a reaction device, and all can be provided without departing from the disclosure. Indeed, the present invention is intended to embrace all such forms, ramifications, modifications, variations, substitutions, and/or equivalents as fall within the spirit and broad scope of the following claims.

What is claimed is:

1. A reaction device for use with forming equipment, comprising:

a base having a return spring passage, and at least two guide shaft passages each spaced apart from the return spring passage;

a reaction member spaced apart from the base;

a return spring received in the return spring passage of the base and carried by the base, the return spring having a rod with an end arranged for contact with the reaction member;

a guide bushing received in each guide shaft passage of the base and carried by the base, at least one of the guide bushings having an end projecting below the base for use in locating the reaction device on the forming equipment;

a guide shaft received in each guide bushing, and at least one guide shaft having an end arranged for engagement with the reaction member; and the reaction member includes at least two guide shaft apertures, at least one of the guide shaft apertures includes a flat portion and an end of at least one of the guide shafts includes a corresponding flat portion for engagement with the flat portion of the reaction member.

2. A reaction device for use with forming equipment, comprising:

a base having a return spring passage, and at least two guide shaft passages each spaced apart from the return spring passage;

a reaction member spaced apart from the base;

a return spring received in the return spring passage of the base and carried by the base, the return spring having a rod with an end arranged for contact with the reaction member;

a guide bushing received in each guide shaft passage of the base and carried by the base, at least one of the guide bushings having an end projecting below the base for use in locating the reaction device on the forming equipment;

a guide shaft received in each guide bushing, and at least one guide shaft having an end arranged for engagement with the reaction member; and at least one of the guide bushings is carried by the base with a retaining member therebetween, such that the at least one guide bushing includes at least one external circumferential groove, the base includes a corresponding internal circumferential groove in at least one of the guide shaft passages, and the retaining member is mutually disposed in the grooves.

3. The reaction device of claim 2, wherein the base includes an upper plate and a lower plate, and the corresponding internal circumferential groove is in at least one of the upper and lower plates.

4. The reaction device of claim 2, wherein the at least one guide bushing has at least two spaced apart external circumferential grooves to allow stroke adjustment of the reaction device.

5. A reaction device for use with forming equipment, comprising:

a base having a return spring passage, and at least two guide shaft passages each spaced apart from the return spring passage;

a reaction member spaced apart from the base;

a return spring received in the return spring passage of the base and carried by the base, the return spring having a rod with an end arranged for contact with the reaction member;

a guide bushing received in each guide shaft passage of the base and carried by the base, at least one of the guide bushings having an end projecting below the base for use in locating the reaction device on the forming equipment;

a guide shaft received in each guide bushing, and at least one guide shaft having an end arranged for engagement with the reaction member; and the return spring is carried by the base with a retaining member disposed therebetween, such that the return spring includes at least one external circumferential groove, the base includes a corresponding internal circumferential groove in the return spring passage, and a retaining member is mutually disposed in the grooves.

6. A reaction device for use with forming equipment, comprising:

a base having a return spring passage, and at least two guide shaft passages each spaced apart from the return spring passage;

a reaction member spaced apart from the base;

a return spring received in the return spring passage of the base and carried by the base, the return spring having a rod with an end arranged for contact with the reaction member;

a guide bushing received in each guide shaft passage of the base and carried by the base, at least one of the guide bushings having an end projecting below the base for use in locating the reaction device on the forming equipment;

a guide shaft received in each guide bushing, and at least one guide shaft having an end arranged for engagement with the reaction member; and the at least one guide bushing is carried by the base in an axially adjustable manner.

7. The reaction device of claim 6, wherein the at least one guide bushing includes at least two spaced apart external circumferential grooves, the base includes a corresponding internal circumferential groove in at least one of the guide shaft passages, and a retaining member is mutually disposed in the grooves.

8. A reaction device for use with forming equipment, comprising:

a base having a return gas spring passage, and at least two guide shaft passages each spaced apart from the return gas spring passage;

a reaction member spaced apart from the base and including at least two guide shaft apertures and an intermediate section between the guide shaft apertures, wherein at least one of the guide shaft apertures includes a flat portion;

a return gas spring received in the return gas spring passage of the base and carried by the base, the return gas spring having a piston rod with an end arranged for contact with the intermediate section of the reaction member;

a guide bushing received in each guide shaft passage of the base, at least one guide bushing having an end projecting below the base for use in locating the reaction device on the forming equipment, the at least one guide bushing having at least one external circumferential groove, the base having a corresponding internal circumferential groove in at least one of the guide shaft passages, and a retaining member being mutually disposed in the grooves; and a guide shaft received in each guide bushing, at least one of the guide shafts including an end arranged for engagement with the reaction member in at least one of the guide shaft apertures thereof, wherein the end of the at least one guide shaft includes a corresponding flat portion for engagement with the flat portion of the reaction member.

9. The reaction device of claim 8, wherein the return gas spring includes at least one external circumferential groove, the base includes a corresponding internal circumferential groove in the return gas spring passage, and a retaining member is mutually disposed in the grooves.

10. The reaction device of claim 8, wherein the at least one guide bushing includes at least two spaced apart external circumferential grooves to allow stroke adjustment of the reaction device.

11. The reaction device of claim 10, wherein the base includes an upper plate and a lower plate, and the corresponding internal circumferential groove is in at least one of the upper and lower plates.

12. The reaction device of claim 11, wherein the at least one guide bushing includes three spaced apart external circumferential grooves.

13. The reaction device of claim 8, wherein the return gas spring includes a cylinder carrying the piston rod and having at least one external circumferential groove, the base includes a corresponding internal circumferential groove in the return gas spring passage, and a retaining member is mutually disposed in the grooves.

14. The reaction device of claim 8, wherein the at least one guide bushing is carried by the base in an axially adjustable manner.

15. The reaction device of claim 14, wherein the at least one guide bushing has at least two spaced apart external circumferential grooves, the base includes a corresponding internal circumferential groove in at least one of the guide shaft passages, and a retaining member is mutually disposed in the grooves.

16. A reaction device for use with forming equipment, comprising:

a base including an upper plate and a lower plate, and having a return gas spring passage and at least two guide shaft passages each spaced apart from the return gas spring passage;

a reaction member spaced apart from the base and including at least two guide shaft apertures and an intermediate section between the guide shaft apertures, wherein at least one of the guide shaft apertures includes a flat portion;

a return gas spring received in the return gas spring passage of the base and carried by the base, the return gas spring having a piston rod with an end arranged for contact with the intermediate section of the reaction member;

a guide bushing received in each guide shaft passage of the base, the guide bushings having an end projecting below the base for use in locating the reaction device on the forming equipment, the guide bushings having at least two external circumferential grooves to allow stroke adjustment of the reaction device, the base having a corresponding internal circumferential groove in at least one of the guide shaft passages, and a retaining member being mutually disposed in the grooves; and a guide shaft received in each of the guide bushings, at least one of guide shafts including an end arranged for engagement with the reaction member in one of the guide shaft apertures thereof, wherein the end of the at least one guide shaft includes a corresponding flat portion for engagement with the flat portion of the reaction member.

17. The reaction device of claim 16, wherein the return gas spring includes at least one external circumferential groove, the base includes a corresponding internal circumferential groove in the return gas spring passage, and a retaining member is mutually disposed in the grooves.

18. A reaction device for use with forming equipment, comprising:

a base having a return spring passage, and at least two guide shaft passages each spaced apart from the return spring passage;

a reaction member spaced apart from the base and including at least two guide shaft apertures and an intermediate section between the guide shaft apertures, wherein at least one of the guide shaft apertures includes a flat portion;

a return spring received in the return spring passage of the base and carried by the base, the return spring having a piston rod with an end arranged for contact with the intermediate section of the reaction member; and a guide shaft received in each guide shaft passage, at least one of the guide shafts including an end arranged for engagement with the reaction member in at least one of the guide shaft apertures thereof, wherein the end of the at least one guide shaft includes a corresponding flat portion for engagement with the flat portion of the reaction member.

19. The reaction device of claim 18, further comprising:

a guide bushing received in each guide shaft passage of the base, the guide bushings having ends projecting below the base for use in locating the reaction device on the forming equipment, wherein the guide shafts are received in the guide bushings.

20. The reaction device of claim 18, further comprising:

a guide stop attached to each end of the guide shafts to retain the guide shafts in the base, and including a resilient cushion sandwiched between at least one cushion washer and a head of a guide stop shoulder screw fastened to its respective guide shaft end.

21. The reaction device of claim 20, wherein the thickness of the at least one cushion washer is selective to enable adjustment in the stroke length of the reaction device.

* * * * *